United States Patent [19]

Lewis

[11] 4,375,709

[45] Mar. 8, 1983

[54] CONCRETE WORKING TOOL

[76] Inventor: James R. Lewis, 2079 E. 1000, N., LaPorte, Ind. 46350

[21] Appl. No.: 218,198

[22] Filed: Dec. 19, 1980

[51] Int. Cl.[3] ..... E01C 19/12

[52] U.S. Cl. ..... 15/235.4; 15/235.6

[58] Field of Search ..... 15/235.3, 235.4, 235.5, 15/235.6, 235.7, 235.8; D8/45

[56] References Cited

U.S. PATENT DOCUMENTS

D. 240,007 5/1976 Cardenas ..... D8/45
2,561,521 7/1951 Lent ..... 15/235.6 X
3,140,500 7/1964 Pilla ..... 15/235.4

FOREIGN PATENT DOCUMENTS 74796 10/1952 Denmark ..... 15/235.4
2263791 7/1974 Fed. Rep. of Germany ..... 15/235.4

*Primary Examiner*—Robert L. Bleutge
*Attorney, Agent, or Firm*—James D. Hall

[57] ABSTRACT

A tool for working concrete. The body of the tool has a face with multiple openings and is used to tamp gravel from the surface of the concrete and bring the cream to the surface.

1 Claim, 4 Drawing Figures

CONCRETE WORKING TOOL

SUMMARY OF THE INVENTION

This invention relates to a tool for working concrete and particularly to a tool with a face having multiple openings.

Working with concrete having stones or gravel at the surface can create problems in finishing. The mason must force the gravel into the body of the concrete in order to facilitate finishing the surface. A number of tools are available to perform the above task. One of the existing tools is large with circular holes in the tamping face. When using this tool, the surface of the concrete is struck with force. This causes splashing of the concrete into the mason's face. Another tool places louvers behind the holes to divert the splashing to a side. Therefore, instead of having the concrete splash into the mason's face, his clothes or some other nearby object are prone to be covered by the splashing. Additionally, the prior tools were large, cumbersome and difficult to maneuver in tight spaces and corners.

The present invention alleviates these problems by utilizing openings having selected opening sizes and shapes on the face of the tool. The face is composed of a steel mesh with a plurality of diamond shaped rectangles formed therein. When using the invention, a less forceful stroke is required, thus reducing the possibility of splashing. Even with a forceful stroke, the multiple rectangular openings act to catch the gravel and force it into the body of the concrete and not splash the surface cream.

In addition to the mesh face, the tool is of a size to allow its use with only one hand. By using one hand, the mason is better able to control the stroke and placement of the tool. The frame which supports the face is rectangular with each corner formed into a different curvature to facilitate tamping concrete in corners of varying configurations.

Accordingly, it is an object of this invention to provide a means of tamping gravel in concrete.

Another object is to provide a concrete tamping tool which is easily used with one hand.

Still another object is to provide a concrete tamping tool which can be used in corners.

Other objects will become apparent upon a reading of the following description.

DESCRIPTION OF THE PREFERRED EMBODIMENT

Figure 1:
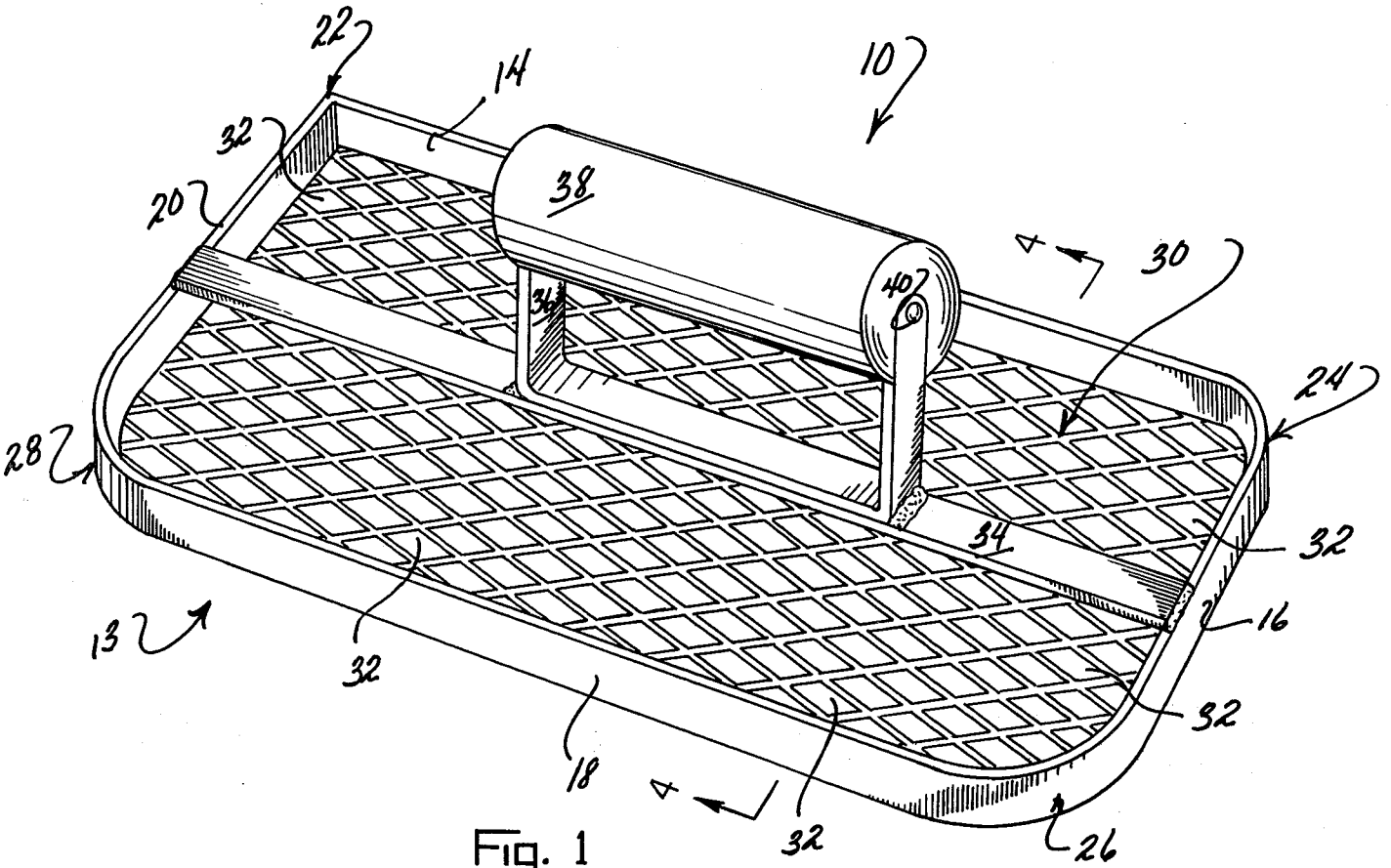
FIG. 1 is a perspective view of the concrete tamping tool.
Figure 2:
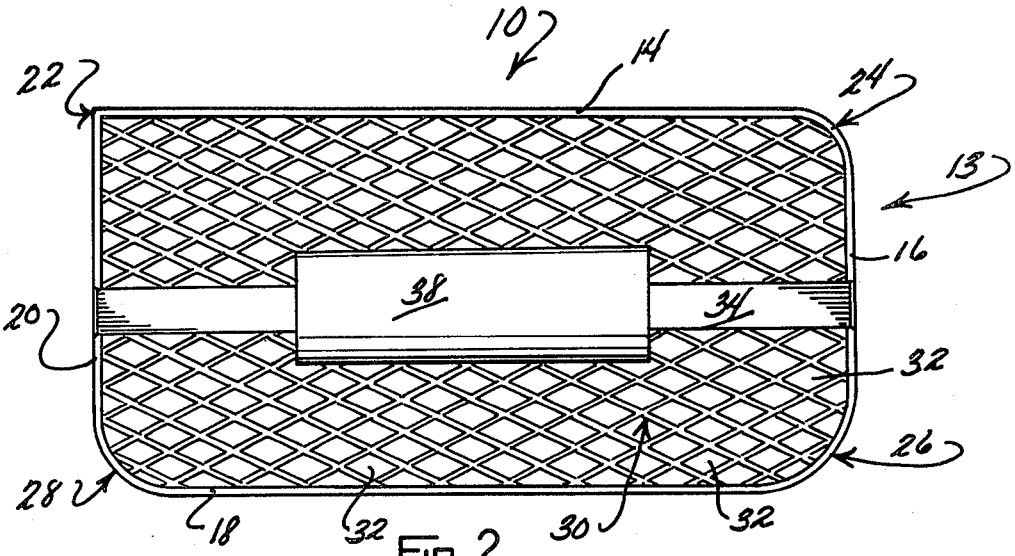
FIG. 2 is a top plan view of the concrete tamping tool.
Figure 3:
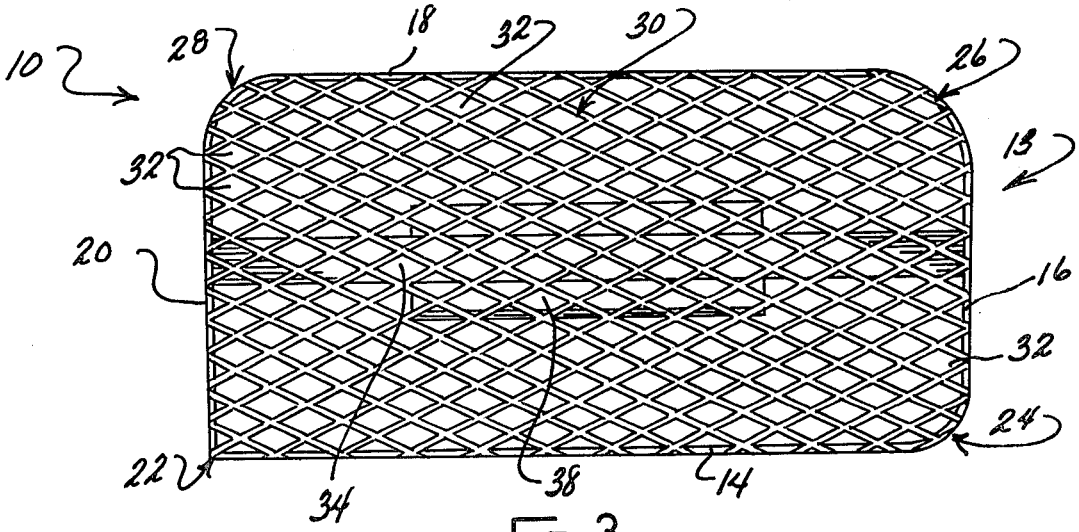
FIG. 3 is a bottom plan view of the concrete tamping tool.
Figure 4:
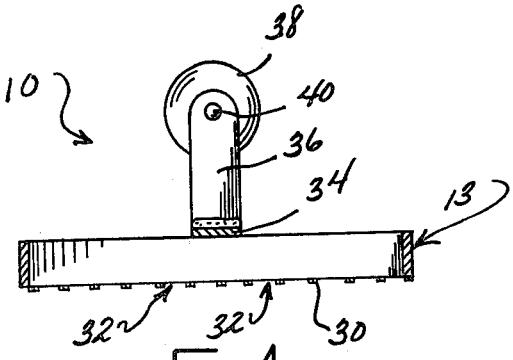
FIG. 4 is a cross sectional view taken along line 4—4 of FIG. 1.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

The tool 10 includes a frame 13 which is formed of a continuous rigid strip formed into a rectangular shape with four sides 14, 16, 18, 20 which intersect to form corners 22, 24, 26, 28. Each corner 22, 24, 26, 28 is preferably of a different shape or configuration to accommodate a specific formed corner. Affixed to the bottom edge of frame 13 is a tamping face 30. Face 30 is formed of a mesh material with a plurality of diamond shaped openings 32 therein. A slat 34 spans the length of frame 13 and is affixed to the top edge of frame 13. Slat 34 carries a U-shaped bracket 36. A handle 38 is secured to bracket 36 by screws 40.

In utilizing tool 10, handle 38 is gripped in a manner to allow the greatest amount of control by the mason. Face 30 is tamped into a body of concrete. Openings 32 are of a size to prohibit gravel in the concrete to pass through, thereby forcing the gravel into the body of the concrete and leaving only the cream or pure concrete at the surface for finishing. The variety of shapes of corners 22, 24, 26, 28 allow tool 10 to function in various shaped form corners.

It is understood that the invention is not to be limited to the preceding description but may be modified within the scope of the appended claims.

What I claim is:

1. A concrete working tool comprising a body and a handle, said body defined by an open multiple sided enclosed frame, said frame including top and bottom edges, a face part mounted across said frame bottom edge, said face part having a plurality of openings formed therein, a handle connected to said frame and extending above said frame bottom edges, said face part formed of a mesh material, said frame being four sided and of a generally rectangular shape, each corner of said generally rectangularly shaped frame having a contour different from the contour of each other corner whereby said tool may be fitted flush into variously shaped form corners.

* * * * *